US010828910B2

(12) United States Patent
Chopra et al.

(10) Patent No.: US 10,828,910 B2
(45) Date of Patent: Nov. 10, 2020

(54) TEXTILE PRETREATMENT FOR DIGITAL PRINTING

(71) Applicants: Xerox Corporation, Norwalk, CT (US); Palo Alto Research Center Incorporated, Palo Alto, CA (US)

(72) Inventors: Naveen Chopra, Oakville (CA); Paul J. McConville, Webster, NY (US); Jennifer L. Belelie, Oakville (CA); Anthony S. Condello, Webster, NY (US); Robert A. Street, Palo Alto, CA (US); Warren Jackson, San Francisco, CA (US)

(73) Assignees: Xerox Corporation, Norwalk, CT (US); Palo Alto Research Center, Palo Alto, CA (US)

( * ) Notice: Subject to any disclaimer, the term of this patent is extended or adjusted under 35 U.S.C. 154(b) by 54 days.

(21) Appl. No.: 15/921,823

(22) Filed: Mar. 15, 2018

(65) Prior Publication Data

US 2019/0284757 A1 Sep. 19, 2019

(51) Int. Cl.

| | |
|---|---|
| ***B41J 3/407*** | (2006.01) |
| ***B41J 3/00*** | (2006.01) |
| *D06P 5/30* | (2006.01) |

(52) U.S. Cl.

CPC ..... *B41J 3/4078* (2013.01); *B41J 3/00* (2013.01); *B41J 3/407* (2013.01); *D06P 5/30* (2013.01)

(58) Field of Classification Search

CPC ..... D06P 5/30; D06P 5/002; D06P 1/5242; D06P 5/22; D06P 5/2077; D06P 1/5264;

(Continued)

(56) References Cited

U.S. PATENT DOCUMENTS 5,876,745 A * 3/1999 Muraoka ..... A61K 9/7053 424/443
2002/0051753 A1* 5/2002 Saito ..... A61P 23/02 424/49

(Continued)

FOREIGN PATENT DOCUMENTS

| | | |
|---|---|---|
| WO | 2014014453 A1 | 1/2014 |
| WO | 2016025319 A1 | 2/2016 |
| WO | 2017069752 A1 | 4/2017 |

OTHER PUBLICATIONS

Canadian Office Action and Examination Report for Canadian Application No. 3,036,611 dated Apr. 6, 2020, 4 pages.

(Continued)

*Primary Examiner* — Henok D Legesse

(74) *Attorney, Agent, or Firm* — Hoffman Warnick LLC

(57) ABSTRACT

The present teachings include a process, system and article for forming a printed image on a textile. In some embodiments, the process includes coating the textile with a layer of polydiallyldimethyl ammonium chloride cationic polymer and coating the textile with the layer of polydiallyldimethyl ammonium chloride cationic polymer with a layer of poly-4-styrene sulfonate anionic polymer. The process can further include applying an ink composition to the textile having the layer of polydiallyldimethyl ammonium chloride cationic polymer layer and the layer of poly-4-styrene sulfonate anionic polymer, forming an image.

12 Claims, 3 Drawing Sheets

(58) Field of Classification Search
CPC ..... D06P 1/5221; B41J 3/00; B41J 3/4078; B41J 3/407
See application file for complete search history.

(56) References Cited

U.S. PATENT DOCUMENTS

| | | | | |
|---|---|---|---|---|
| 2003/0157304 | A1 | 8/2003 | Li et al. | |
| 2007/0092666 | A1 | 4/2007 | Hood et al. | |
| 2007/0103529 | A1* | 5/2007 | Pearl | B41J 3/28 347/101 |
| 2015/0037578 | A1* | 2/2015 | Kataoka | C09J 7/29 428/354 |

OTHER PUBLICATIONS

EP Search Report and Written Opininon for corresponding EP Application No. 19162674.6 dated Jul. 25, 2019, 8 pgs.

* cited by examiner

TEXTILE PRETREATMENT FOR DIGITAL PRINTING

BACKGROUND

Field of Use

This disclosure is generally related to the field of printing and, more particularly, to novel methods and apparatuses for high-resolution, high-definition multicolor direct printing on textile surfaces.

Background

Industrial printing on textiles is performed using processes such as screen-printing or dye-sublimation. These processes are time-consuming, and are not amenable to short-run, variable pattern print runs, or printing directly on objects, such as footwear. Digital printing of textiles is currently only 2.9% of the total textile printing market. However, digital printing of textiles is expected to grow. Substrates with poor wetting properties are not designed to receive printing inks as color saturation and image robustness is lacking.

SUMMARY

According to various embodiments, there is provided a process of printing an image on a textile. The process includes coating the textile with polydiallyldimethyl ammonium chloride cationic polymer to form a cationic polymer layer. The process includes coating the textile with the cationic polymer layer with poly-4-styrene sulfonate anionic polymer to form an anionic polymer layer. The process includes applying an ink composition to the textile having the cationic polymer layer and the anionic polymer layer, forming an image.

According to various embodiments, there is disclosed a system for printing an image on a textile. The system includes a coating station for applying a polydiallyldimethyl ammonium chloride cationic polymer to the textile. The system includes a coating station for applying a poly-4-styrene sulfonate anionic polymer to the textile. The system includes an ink jet printer for applying an ink composition to the textile to form an image.

According to various embodiments there is disclosed, a printed article that includes a fabric having a first layer of polydiallyldimethyl ammonium chloride cationic polymer and a second layer of poly-4-styrene sulfonate anionic polymer disposed on the polyester fabric. The printed article includes a cured ink composition disposed on the fabric.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1A:
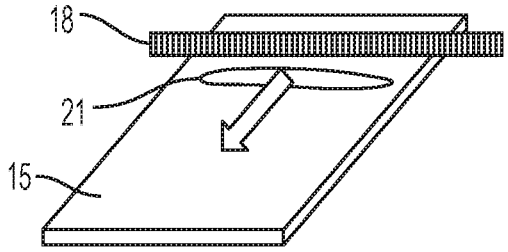
FIGS. 1A-1C show schematic depictions of a textile undergoing a method according to embodiments disclosed herein.

It should be noted that some details of the drawings have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely illustrative.

Illustrations with respect to one or more implementations, alterations and/or modifications can be made to the illustrated examples without departing from the spirit and scope of the appended claims. In addition, while a particular feature may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Disclosed herein is a process for treating textiles including synthetic fabrics, such as polyester, to improve the digital printing of images on such fabrics. Digital printing includes using ink-jet printers and aerosol printers.

Inkjet printing is a type of computer printing that recreates a digital image by propelling droplets of ink onto a substrate. Ink jet material deposition uses inkjet technologies, typically printheads using piezoelectric crystals, to deposit materials directly on substrates.

In order to overcome the textile wettability issue, disclosed herein is a pre-treatment process providing a layer-by-layer printing of polyelectrolytes, such as PDAD (polydiallyldimethyl ammonium chloride) cationic polymer alternating with PSS (poly-4-styrene sulfonate) anionic polymer to create a charged coating with surface roughness to increase the substrate receptivity for ink. PDAD and PSS are shown below:

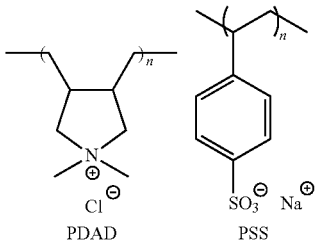

For PDAD, the molecular weight can range from less than 100,000 to about 500,000. In embodiments, the unit mass Mw is 161.67 for PDAD. In embodiments, n can be from 300 to 3100 for PDAD. For PSS, the molecular weight can range from about 75,000 to about 200,000, corresponding to an n value of from about 360 to about 1,000.

Cationic Polymer Solution

The cationic polymer solution includes PDAD (polydiallyldimethyl ammonium chloride) cationic polymer and solvent. In addition, the cationic polymer solution can contain surfactants and humectants.

Anionic Polymer Solution

The anionic polymer solution includes PSS (poly-4-styrene sulfonate) anionic polymer and solvent. In addition the anionic polymer solution can contain surfactants and humectants.

Solvents

In embodiments, solvents are mixtures of water and water-miscible polar solvents such as: methanol, ethanol, 2-propanol, acetone, tetrahydrofuran (THF), as well as less-volatile solvents such as DMF (dimethyl formamide), or NMP (N-methyl-2-pyrrolidone). In embodiments, water-soluble organic solvents include: alcohols, ketones, keto-alcohols, ethers and others, such as thiodiglycol, sulfolane, 2-pyrrolidone, 1,3-dimethyl-2-imidazolidinone and caprolactam; glycols such as, ethylene glycol, diethylene glycol, triethylene glycol, tetraethylene glycol, propylene glycol, dipropylene glycol, tripropylene glycol, trimethylene glycol, butylene glycol and hexylene glycol; polyethylene glycol, polypropylene glycol and the like; triols such as glycerol and 1,2,6-hexanetriol; lower alkyl ethers of polyhydric alcohols, such as ethylene glycol monomethyl ether, ethylene glycol monoethyl ether, diethylene glycol monomethyl, diethylene glycol monoethyl ether; lower dialkyl ethers of polyhydric alcohols, such as diethylene glycol dimethyl or diethyl ether; urea and substituted ureas.

Surfactants

In embodiments, surfactants are added to the polymer solutions to adjust surface tension and wetting properties. In embodiments, surfactants include: anionic surfactants such as: SDS (sodium dodecyl sulfonate), SDBS (sodium dodecyl benzenesulfonate), as well as non-ionic surfactants such as: Triton-X100 (ethoxylated nonylphenol). In embodiments, surfactants include ethoxylated acetylene diols (e.g. SURFYNOLS (R series from Air Products)), ethoxylated primary (e.g. NEODOL® series from Shell and TOMADOL® series from Tomah Products) and secondary alcohols (e.g. TERGITOL® series from Union Carbide), sulfosuccinates (e.g. AEROSOL® series from Cytec), organosilicones (e.g. SILWET® series from GE Silicones) and fluoro surfactants (e.g. ZONYL® series from DuPont). Surfactants are typically used in the amount of about 0.01 to about 5% and preferably about 0.2 to about 2%, based on the total weight of the polymer solution.

Humectants

The polymer solutions may also contain a humectant, which may also function as a water miscible solvent, which preferably includes a glycol or dihydroxyglycol ether, or mixture thereof, in which one or both hydroxy groups are secondary hydroxy groups, such as propane-1,2-diol, butane-2,3-diol, butane-1,3-diol and 3-(3-hydroxy-prop-2-oxy)propan-2-ol. Where the humectant has a primary hydroxy group, in embodiments this may be attached to a carbon atom adjacent to a carbon atom carrying a secondary or tertiary hydroxy group. The humectant may include up to a total of 10 percent by weight of a polyol, especially a glycol or dihydroxyglycol ether, having two or more primary hydroxy groups, such as ethyleneglycol, propane-1,3-diol, butane-1,4-diol, 2-(2-hydroxyethoxy)ethanol and 2-(2-[2-hydroxyethoxy]ethoxy)ethanol and/or an alcohol with a primary hydroxy group, such as ethanol, n-propanol and n-butanol. In the context of the humectant, the term "alcohol" means a compound having only one hydroxy group attached to an aliphatic carbon atom. The polymer solution may contain from 5 weight percent to about 25 weight percent, or in embodiments, from 10 weight percent to 20 weight percent of humectant.

Figure 1B:
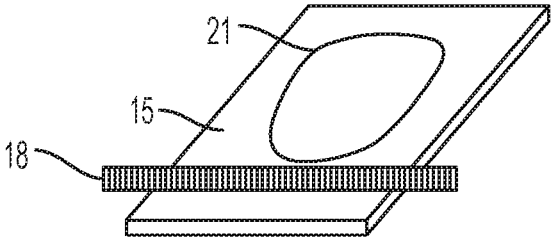
Figure 1C:
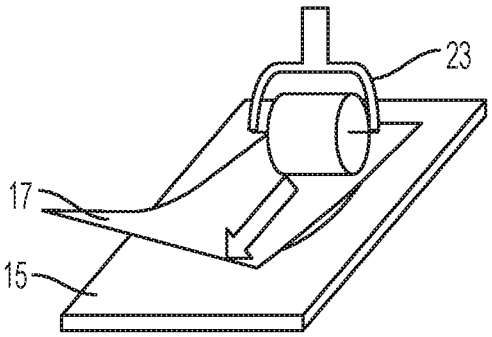

In an embodiment, a method of treating a textile for the subsequent reception of a printing ink, is shown in the schematic illustrations of FIGS. 1A-1C. The method shown in FIG. 1A-1C is one example and other methods of coating textiles with a solution can be used. In FIG. 1A, a coating solution 21 is applied on a glass plate 15. A coating rod 18 is used to spread the coating solution on the glass plate and is shown in FIG. 1B. The coating solution 21 is illustrated as spread on the glass plate 15 in FIG. 1B. As shown in FIG. 1C, the textile or fabric 17 is then placed on the glass plate 15 and a roller 23 is used to immerse the textile 17 in the coating solution 21 on glass plate 15 so that the coating solution 21 contacts all portions of the textile 17. After the fabric 17 is coated with coating solution 21 the solution is dried or cured.

The coating solution 21 can be either the cationic polymer solution or the anionic coating solution. At least one layer of (polydiallyldimethyl ammonium chloride) cationic polymer and one layer of (poly-4-styrene sulfonate) anionic polymer are provided on the textile. The layer of (polydiallyldimethyl ammonium chloride) cationic polymer and layer of (poly-4-styrene sulfonate) anionic polymer are alternated during the coating process. It does not matter which polymer solution is applied initially. There can be more than one layer of each polymer solution. In embodiments, there is an equal number of cationic polymer and anionic polymer solutions applied to the fabric or textile such as A-C-A-C or C-A-C-A where (A) refers to an anionic polymer layer and (C) refers a cationic polymer layer. In embodiments, there can be one additional layer of an anionic or cationic polymer. For example, a layer configuration of C-A-C (a cationic layer is the final layer) or A-C-A (an anionic layer is the final layer) are embodiments.

The total thickness of the anionic polymer layers and cationic polymer layers can be from about 1.0 microns to about 300 microns. Each anionic polymer layer or cationic polymer layer can have a thickness of from about 0.01 microns to about 0.5 microns.

Textiles that are suitable for use of the pre-treatment disclosed herein include, for example, woven fabrics, knitted fabrics, and non-woven fabrics such as felt fabrics. The textiles, may include fibers from any animal, plant and/or synthetic source such as, for example, wool, silk, cotton, linen, hemp, ramie, jute, acetate, acrylic fabric, latex, nylon, polyester, rayon, viscose, spandex, metallic composite, carbon or carbonized composite, and any combination thereof.

The process disclosed herein is highly suitable for garments made of one or more textile fabrics. An example of such a garment is a T-shirt.

The presently available inks for ink-jet printing include aqueous-based inks. The inks contain water, a humectant, a water soluble polymer, a surfactant and a colorant.

Aqueous-based inks are typically composed of water and a colorant, usually a dye or pigment dispersion, and may contain a number of additives for imparting certain features to the ink (e.g., improved stability and flow, feather resistance, and the like).

The term "colorant" as used herein describes a substance which imparts the desired color to the printed image. The colorant may be a pigment or a dye. Pigments are solid colorants with are typically suspended in the carrier of the ink composition, whereby dyes are liquid colorants which are dissolved in the carrier of the ink composition.

Apart for imparting the desired color to the textile, the colorant is selected suitable in terms of its chemical and physical properties. Example dye colorants that are suitable for use in embodiments include, without limitation, azo chrome complexes such as the commercially available Orasol black RLI, Orsal Red G and CU phthalocyanine and similar azo-cobalt complexes. Example pigment colorants that are suitable for use in this context of the present invention include, without limitation, quinacridone, benzimidazolone, carbon black, phthalocyanine, diarylide, azo, titanium oxide and calcium carbonate. Example commercially available pigments can include Permajet, Renol and Microlith.

Preferably, the colorant content in the ink composition according to embodiments ranges from about 0.2% to about 40% of the total weight of the ink composition. In embodiments, the colorant content ranges from 1 to 10 weight percentages of the total weight of the ink composition. The ink composition can contain the solvents and humectants listed previously.

Figure 2:
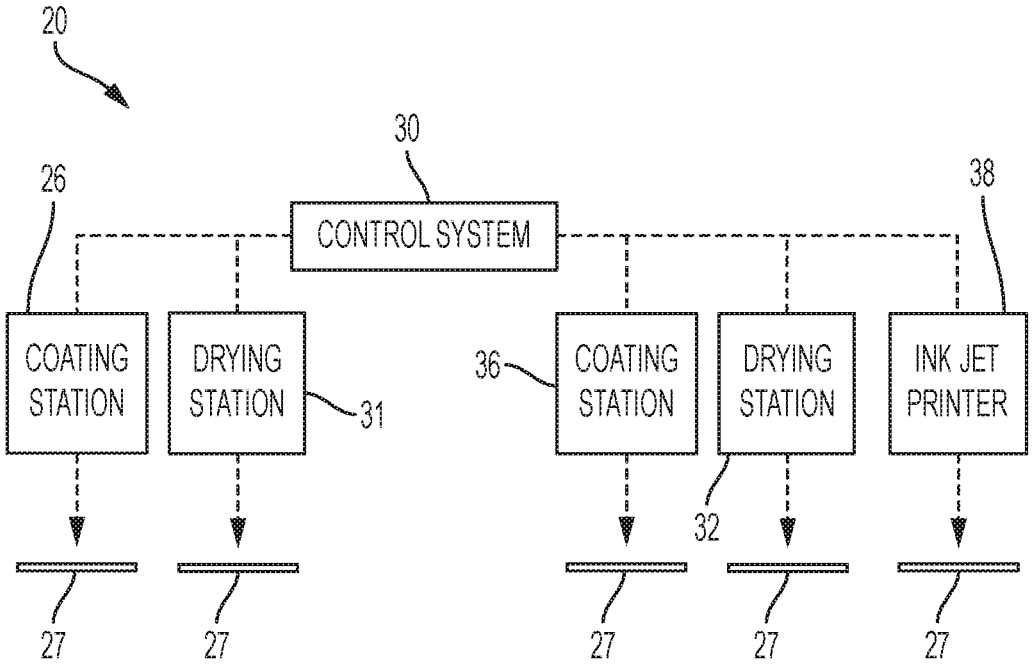
FIG. 2 shows a schematic depiction of a printing system for various embodiments disclosed herein.

FIG. 2 shows a printing system 20 for producing a textile having an image thereon according to various embodiments. The system 20 includes a coating station 26 for applying a cationic polymer solution to the textile 27. The textile 27 is dried at drying station 31. The system 20 includes a coating station 36 for applying a anionic polymer solution to the textile 27. The textile 27 is dried at drying station 32. The textile 27 is printed using an ink jet printer 38 to form an image on the textile 27. The printing system 20 can include a control system 30 coupled to the coating station 26, drying station 31, coating station 36, drying station 32, and ink jet printer 38. In embodiments, the drying station 31 and drying station 32 can be one drying station. Likewise, in embodiments the coating station 26 and coating station 36 can be one apparatus and the flow of the anionic and cationic solution adjusted accordingly. The control system 30 can be configured to provide instructions to, and/or otherwise control operation of coating station 26, drying station 31, coating station 36, drying station 32, and/or ink jet printer 38. The control system 30 may be mechanically or electrically connected to coating station 26, drying station 31, coating station 36, drying station 32, and/or ink jet printer 38. Control system 30 may be a computerized, mechanical, or electro-mechanical device capable of controlling the coating station 26, drying station 31, coating station 36, drying station 32, and ink jet printer 38. In one embodiment, control system 30 may be a computerized device capable of providing operating instructions to the coating station 26, drying station 31, coating station 36, drying station 32, and/or ink jet printer 38. In another embodiment, control system 30 may include a mechanical device, capable of use by an operator. In this case, the operator may physically manipulate control system 30 (e.g., by pulling a lever), which may actuate the coating station 26, drying station 31, coating station 36, drying station 32, and ink jet printer 38. In another embodiment, control system 30 may be an electro-mechanical device.

Figure 3:
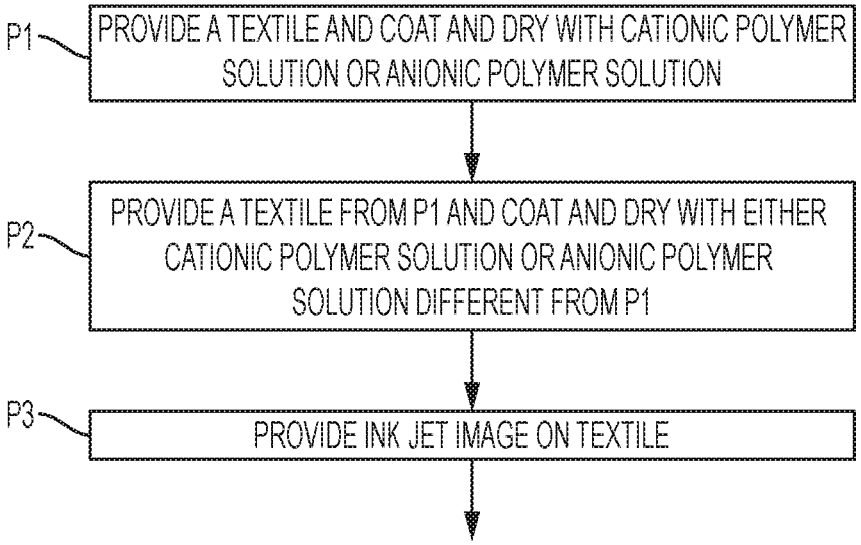
FIG. 3 shows a flow chart illustrating a method according to various embodiments disclosed herein.

FIG. 3 shows a flow chart illustrating a method performed according to various embodiments. As shown, the method can include the following processes:

Process P1: A textile is provided and coated with a cationic polymer solution or anionic solution and dried.

Process P2: The textile coated with the dried cationic polymer solution or dried anionic polymer solution is then coated and dried with a solution of cationic polymer solution or anionic polymer solution different from the solution in P1 process step.

Process P3: An ink jet composition is coated on the textile having a cationic polymer and an anionic polymer layer to form and image.

Specific embodiments will now be described in detail. These examples are intended to be illustrative, and not limited to the materials, conditions, or process parameters set forth in these embodiments. All parts are percentages by solid weight unless otherwise indicated.

EXAMPLES

A polyester fabric was coated with PDAD and PSS alternating layers by transferring a coating of PDAD on a glass plate applied with a #22 Meyer rod, as shown in FIGS. 1A-1C, to the polyester fabric, and then alternatively coating with a PSS coating laid down on a separate glass plate as shown in FIGS. 1A-1C. The process was performed four times to give a coating of PDAD-PSS-PDAD-PSS on the polyester substrate. The coating showed good affinity for polyester.

An inkjet printer with a piezoelectric printhead is loaded with both cationic and anionic solutions. Examples of printers that include Dimatix Materials Printer DMP-2850 (Fuji-Film), or F-Series or X-Series printers (Ceradrop) The ink jet printer applies the ink compositions to a polyester substrate resulting in PDAD-PSS-PDAD-PSS on the polyester substrate. An ink jet printer applies an image on the polyester substrate having the PDAD-PSS-PDAD-PSS layers It will be appreciated that variants of the above-disclosed and other features and functions or alternatives thereof may be combined into other different systems or applications. Various presently unforeseen or unanticipated alternatives, modifications, variations, or improvements therein may be subsequently made by those skilled in the art, which are also encompassed by the following claims

What is claimed is:

1. A printed article, comprising:

a woven fabric having a first layer of polydiallyldimethyl ammonium chloride cationic polymer and a second layer of poly-4-styrene sulfonate anionic polymer coated on the woven fabric, wherein the first layer contacts all portions of the woven fabric, wherein the second layer contacts all portions of the first layer; and a cured ink composition on the woven fabric.

2. The article of claim 1, wherein an uncured ink composition comprising water, a humectant, a water-soluble polymer, a surfactant and a colorant is disposed on the woven fabric and cured.

3. The article of claim 1, wherein the woven fabric is selected from the group consisting of: wool, silk, cotton, linen, hemp, ramie, jute, acetate, acrylic, latex, nylon, polyester, rayon, viscose and spandex.

4. The article of claim 1, wherein a combined thickness of the first layer and second layer is from 1.0 microns to about 300 microns.

5. The article of claim 1, wherein the poly-4-styrene sulfonate anionic polymer has a molecular weight of from about 75,000 to about 200,000.

6. The article of claim 1, wherein the polydiallyldimethyl ammonium chloride cationic polymer has a molecular weight of from about 100,000 to about 500,000.

7. A printed article, comprising:

a woven fabric having a first layer of poly-4-styrene sulfonate anionic polymer and a second layer of polydiallyldimethyl ammonium chloride cationic polymer coated on the woven fabric, wherein the first layer contacts all portions of the woven fabric, wherein the second layer contacts all portions of the first layer; and a cured ink composition on the woven fabric.

8. The article of claim 7, wherein an uncured ink composition comprising water, a humectant, a water-soluble polymer, a surfactant and a colorant is disposed on the woven fabric and cured.

9. The article of claim 7, wherein the woven fabric is selected from the group consisting of: wool, silk, cotton, linen, hemp, ramie, jute, acetate, acrylic, latex, nylon, polyester, rayon, viscose and spandex.

10. The article of claim 7, wherein a combined thickness of the first layer and second layer is from 1.0 microns to about 300 microns.

11. The article of claim 7, wherein the poly-4-styrene sulfonate anionic polymer has a molecular weight of from about 75,000 to about 200,000.

12. The article of claim 7, wherein the polydiallyldimethyl ammonium chloride cationic polymer has a molecular weight of from about 100,000 to about 500,000.

* * * * *